343-754 SR
1/24/78 OR 4,070,678

United States Patent [19] [11] 4,070,678
Smedes [45] Jan. 24, 1978

[54] WIDE ANGLE SCANNING ANTENNA ASSEMBLY

[75] Inventor: Richard L. Smedes, Westford, Mass.

[73] Assignee: Raytheon Company, Lexington, Mass.

[21] Appl. No.: 673,239

[22] Filed: Apr. 2, 1976

[51] Int. Cl.[2] ..... H01Q 19/06; H01Q 3/12
[52] U.S. Cl. ..... 343/754; 343/756; 343/761; 343/781 P
[58] Field of Search ..... 343/754, 854, 755, 756, 343/761, 781 P, 839

[56] References Cited

U.S. PATENT DOCUMENTS

| | | | |
|---|---|---|---|
| 3,245,081 | 4/1966 | McFarland | 343/854 |
| 3,916,416 | 10/1975 | Lewis | 343/756 |

*Primary Examiner*—Eli Lieberman
*Attorney, Agent, or Firm*—Philip J. McFarland; Joseph D. Pannone

[57] ABSTRACT

An antenna assembly wherein the direction of a beam of radio frequency energy may be changed by combining the effects of a mechanically movable reflector and an electromagnetic lens is disclosed. In the preferred embodiment the antenna arrangement includes a corporate monopulse feed arranged to produce a linearly polarized divergent beam which is first reflected from a linearly polarized paraboloid to direct a convergent beam toward a mechanically rotatable polarization-twisting reflector. A selected portion of a spherical electromagnetic lens arrangement is illuminated by the still convergent beam from the latter reflector, such lens then determining the direction of the beam finally propagated in free space. The relative positions of the corporate monopulse feed, the linearly polarized paraboloid, the mechanically rotatable polarization-twisting reflector and the characteristics of the spherical electromagnetic lens arrangement are selected so that, for a given antenna assembly for clectromagnetic energy of a given frequency, the linearly polarized divergent beam from the corporate monopulse feed is converted to a substantially collimated beam in free space.

5 Claims, 19 Drawing Figures

FIG. 8A

| B−X | | | | | | | |
|---|---|---|---|---|---|---|---|
| -30 | .25 | .25 | .25 | .25 (0) | .25 | .25 | .25 |
| -20 | .18 | .18 (1.10) | .18 (1.25) | .18 (0) | .18 (.25) | .18 (1.10) | .18 |
| -10 | .10 | .10 (1.26) | .10 (.32) | .10 (0) | .10 (.32) | .10 (1.26) | .10 |
| 0 | 0 (2.93) | 0 (1.34) | 0 (.34) | 0 (0) | 0 (.34) | 0 (1.34) | 0 (2.93) |
| +10 | .10 | .10 (1.26) | .10 (.32) | .10 (0) | .10 (.32) | .10 (1.26) | .10 |
| +20 | .18 (1.10) | .18 (2.25) | .18 (0) | .18 (.25) | .18 (1.10) | .18 | .18 |
| +30 | .25 | .25 | .25 | .25 (0) | .25 | .25 | .25 |
| y | 30 | 20 | 10 | 0 | 10 | 20 | 30 |

FIG. 8B

| B−X | | | | | | | |
|---|---|---|---|---|---|---|---|
| 0 | 0 | 0 | 0 | 0 (0) | 0 | 0 | 0 |
| 10 | .10 | .10 (1.0) | .10 (.23) | .10 (0) | .10 (.23) | .10 (1.0) | .10 |
| 20 | .18 | .18 (1.1) | .18 (.26) | .18 (0) | .18 (.26) | .18 (1.1) | .18 |
| 30 | .25 (2.2) | .25 (1.0) | .25 (.25) | .25 (0) | .25 (.25) | .25 (1.0) | .25 (2.2) |
| 40 | .50 | .50 (.84) | .50 (.22) | .50 (0) | .50 (.22) | .50 (.84) | .50 |
| 50 | .80 | .80 (.60) | .80 (.13) | .80 (0) | .80 (.13) | .80 (.60) | .80 |
| 60 | 1.15 | 1.15 | 1.15 | 1.15 (0) | 1.15 | 1.15 | 1.15 |
| y | 30 | 20 | 10 | 0 | 10 | 23 | 30 |

FIG. 8C

| B−X | | | | | | | |
|---|---|---|---|---|---|---|---|
| 30 | | | | .25 (0) | | | |
| 40 | | .50 (.39) | .50 (.08) | .50 (0) | .50 (.08) | .50 (.39) | |
| 50 | | .80 (.41) | .80 (.11) | .80 (0) | .80 (.11) | .80 (.41) | |
| 60 | 1.15 (.81) | 1.15 (.38) | 1.15 (.10) | 1.15 (0) | 1.15 (.10) | 1.15 (.38) | 1.15 (.81) |
| 70 | | 1.50 (.22) | 1.50 (.06) | 1.50 (0) | 1.50 (.06) | 1.50 (.22) | |
| 80 | | | 1.92 (.02) | 1.92 (0) | 1.92 (.02) | | |
| 90 | | | | 2.35 (0) | | | |
| y | 30 | 20 | 10 | 0 | 10 | 20 | 30 |

FIG. 8D

| B−X | | | | | | | |
|---|---|---|---|---|---|---|---|
| 60 | | | | 1.15 (0) | | | |
| 70 | | 1.50 (.02) | 1.50 (.03) | 1.50 (0) | 1.50 (.03) | 1.50 (.02) | |
| 80 | | 1.92 (.08) | 1.92 (.03) | 1.92 (0) | 1.92 (.03) | 1.92 (.08) | |
| 90 | 2.35 (283 | 2.35 (.147) | 2.35 (.04) | 2.35 (0) | 2.35 (.04) | 2.35 (.147) | (.283) |
| 100 | | 2.95 (.08) | 2.95 (.03) | 2.95 (0) | 2.95 (.03) | 2.95 (.08) | |
| 110 | | | 3.60 (.02) | 3.60 (0) | 3.60 (.02) | | |
| 120 | | | | 4.20 (0) | | | |
| y | 30 | 20 | 10 | 0 | 10 | 20 | 30 |

WIDE ANGLE SCANNING ANTENNA ASSEMBLY

BACKGROUND OF THE INVENTION

This invention pertains generally to antennas for radio frequency energy and particularly to antennas required to produce electromagnetic beams over wide angles of coverage volume.

It has been suggested that a so-called "wide angle scanning array antenna" assembly, as described in U.S. Pat. No. 3,755,815, may be used when it is desired to deflect a radar beam through a deflection angle which may be greater, in any direction, than the maximum feasible deflection angle of a beam from a conventional phased array. Briefly, such an antenna assembly consists of a conventional planar phased array mounted within a structure which acts as a lens. When any portion of such a structure is illuminated in a controlled fashion by a radar beam from the planar phased array, the direction of such radar beam with respect to the boresight line of the planar phased array is changed in a manner analogous to the way in which a prism bends visible light. Thus, the deflection angle of the radar beam propagated in free space may be caused to be much larger than the greatest deflection angle attainable with a planar phased array.

Although an antenna assembly made in accordance with the disclosure of the cited patent is, in theory, suited to the purpose of deflecting a radar beam through extremely wide deflection angles without requiring any rotary joints for the radar energy or mechanical movement of the entire assembly, its complexity militates against its use in many applications.

The complexity of the arrangement described in the patent referred to above is caused mainly by the fact that, for each different position of the beam, the shape of the wavefront of the beam from the planar array must be changed. While the requisite change in shape of the wavefront of the beam from the planar array may be accomplished by controlling the individual antenna elements in such array by signals from a computer, the capacity of the computer must be relatively large if sufficiently precise control of the shape of the wavefront is to be attained to achieve satisfactory collimation of the beam finally propagated in free space.

Another difficulty with the type of antennas disclosed in the cited patent resides in the fact that, when any radar beam is deflected from the normal to the plane of a planar phased array, degradation in beam shape is experienced. Such degradation, which may be deemed to be the result of foreshortening of the aperture of the planar phased array as the deflection angle is increased, limits the maximum feasible deflection angle from such an array to between 45° to 60°. If, then, a deflection angle greater than 90° is required for the beam in free space, it is necessary that the lens structure be effective to cause a relatively large change in beam direction. That is to say, the lens structure must be equivalent to a "thick" lens with the concomitant shortcomings of such a lens.

SUMMARY OF THE INVENTION

With this background of the invention in mind, it is therefore a primary object of this invention to provide an improved wide angle scanning antenna.

Another object of this invention is to provide an improved wide angle scanning antenna assembly wherein degradation of the shape of a radar beam is reduced.

These and other objects of this invention are met by providing an antenna assembly consisting of a shell lens arrangement within which a directive feed is mounted, such feed being arranged so that a beam of electromagnetic energy may be mechanically scanned to illuminate any selected portion of the shell lens arrangement. Collimation of the beam of electromagnetic energy is accomplished by providing, as a primary directive feed, a monopulse horn feed which produces a linearly polarized divergent beam centered on the axis of symmetry of the shell lens arrangement so as to illuminate a polarized paraboloid reflector which is reflective to the electromagnetic energy in the linearly polarized divergent beam. The phase center of the monopulse horn feed and the focal point of the polarized paraboloidal reflector are arranged so that the linearly polarized divergent beam is, upon reflection from such reflector, changed to a linearly polarized convergent beam. Such beam is then reflected from a tiltable polarized planar reflector which, in addition to directing such beam toward the selected portion of the shell lens arrangement, also twists the polarization of such beam by 90°. As a result of such twisting, the sense of the polarization of the radio frequency energy in the linearly polarized convergent beam is such that, if such beam is directed back toward the polarized paraboloidal reflector, such beam passes through such reflector. Upon passing through the shell lens arrangement, the linearly polarized convergent beam is converted to a collimated beam and the direction of such collimated beam is changed as desired. The convergent beam illuminates a desired portion of the inside of the shell lens. The shell lens acts as a prism and amplifies the angular deflection of the primary illumination beam and provides a directive or collimated beam over a larger coverage or deflection angle then provided by the primary beam deflection angle.

BRIEF DESCRIPTION OF THE DRAWINGS

For a more complete understanding of this invention, reference is now made to the accompanying description of the drawings, in which:

FIGS. 8A through 8D are matrices showing how collimations of a beam finally propagated in free space may be effected, in an arrangement such as shown in FIG. 1, by combining the effects of fixed lengths of transmission lines and phase shifters in the shell lens arrangement to compensate for changes in pathlength as the deflection angle of the beam is changed.

DESCRIPTION OF THE PREFERRED EMBODIMENTS

Before referring to the FIGURES it will be convenient to define terms to be used. Thus:

a. A meridional ray is any ray in the plane defined by the axis of symmetry of the antenna assembly and the center ray in the beam illuminating the inside of the shell lens arrangement. (It will be observed that when such axis and ray are coincident, i.e. when the deflection angle is zero, all rays in the beam illuminating the inside of the shell lens arrangement may be deemed to be meridional rays);

b. A nonmeridional ray is any ray in the beam illuminating the inside of the shell lens arrangement which does not lie in the plane defined by the axis of symmetry of the antenna assembly and the center ray of such beam;

c. The deflection angle amplification factor (which may be considered to be analogous to the index of refraction of an optical lens) is the ratio between the deflection angle of the beam finally propagated in free space and the deflection angle of the central ray of the beam illuminating the inside of the shell lens arrangement, both such angles being measured in the meridional plane with respect to the axis of symmetry of the antenna assembly.

Figure 1:
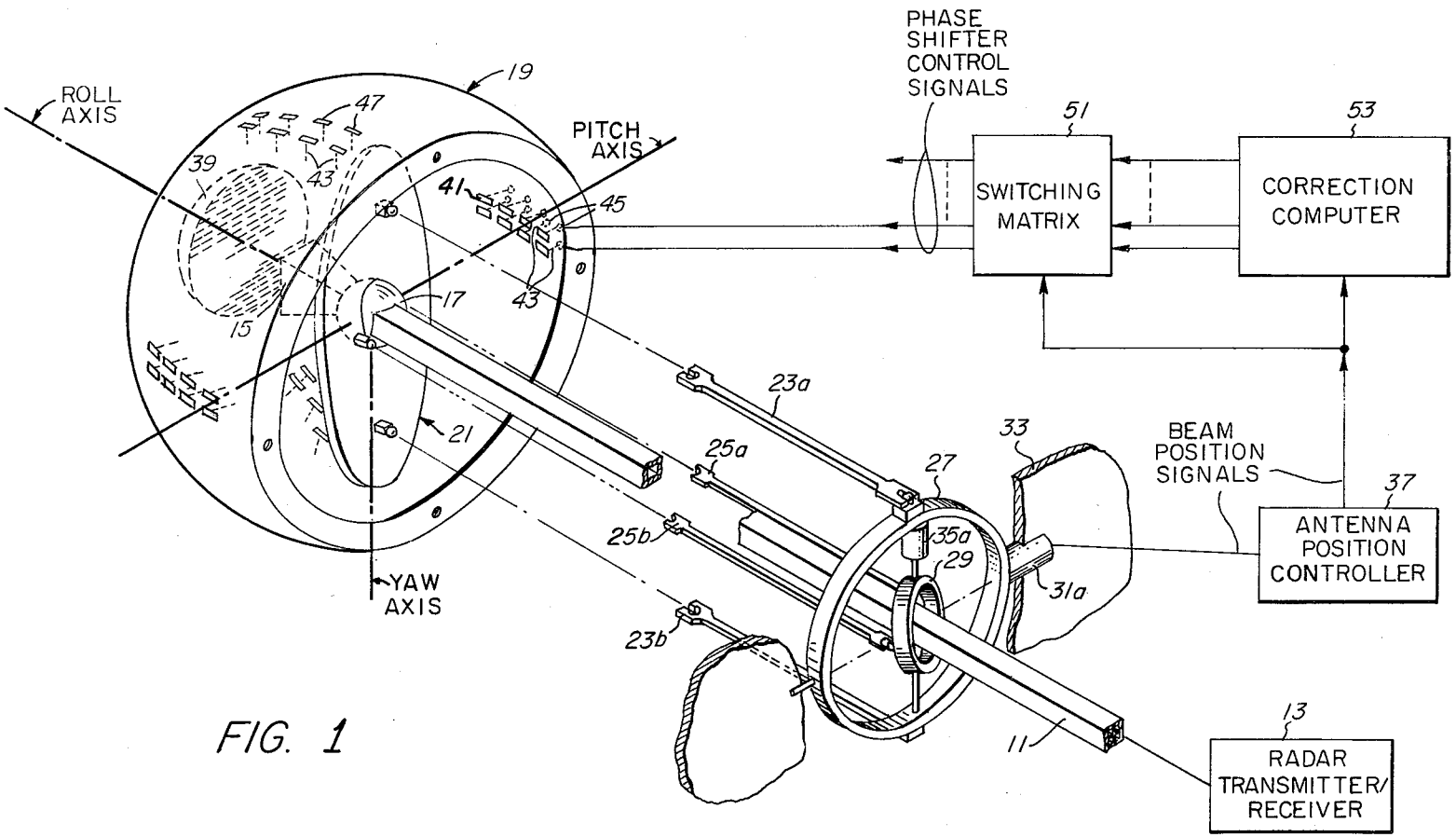
FIG. 1 is an exploded isometric view, greatly simplified to show the essential elements of a preferred embodiment of an antenna assembly according to this invention.

Referring now to FIG. 1, a preferred embodiment of the contemplated antenna assembly is shown which allows a beam of radio frequency energy to be scanned in any desired direction within a volume in excess of $2\pi$ steradians without requiring any mechanically movable rotary joint for such energy. Thus, according to this invention, radio frequency energy is fed through a waveguide 11 from a radar transmitter receiver 13 to a monopulse horn feed 15 and then, in a manner to be described, is directed in a collimated beam in any desired direction consistent with the parameters of this invention. The waveguide 11 passes through a ball joint 17 which is supported in any convenient manner (not shown) at the center of a shell lens arrangement 19. A planar reflector 21 (which also serves to rotate the polarization of incident energy in a manner to be described in connection with FIGS. 2A and 2B) is mounted on the ball joint 17 so that its reflecting surface may be oriented as desired with respect to the longitudinal axis of the waveguide 11. That is to say, the reflecting surface of the planar reflector 21 may be oriented with respect to the axis of symmetry of the antenna arrangement at any angle (within a volume of, say, 1.2 steradians about such axis) and still operate to reflect energy in a proper manner. In the illustrated example, the orientation of the planar reflector 21 is effected by means of a pair of orthogonally disposed parallelogram linkages now to be described. Each one of such linkages comprises a pair of arms 23*a*, 23*b* and 25*a*, 25*b*. Arms 23*a*, 23*b* are connected, by means of an inner gimbal 29, to an outer gimbal 27 and arms 25*a*, 25*b* are similarly connected to the inner gimbal 29 and the outer gimbal 27 which is mounted, through a torque motor 31*a*, to a bulkhead 33. The inner gimbal 29 is supported in the outer gimbal 27 by a torque motor 35*a*. The torque motors 31*a*, 35*a* are energized as desired by an antenna position controller 37.

It will be appreciated that the just-described arrangement is conventional in nature and that orientation of the planar reflector 21 may be effected in any other convenient manner without departing from the inventive concepts here to be set forth.

A polarized paraboloid 39 of conventional construction is mounted in any convenient manner (not shown) within the shell lens arrangement 19. It may be seen that, if the energy from the monopulse horn 15 is linearly polarized in the same sense as the direction of of the wires (not numbered here) in the polarized paraboloid 39, then such energy will be reflected in a converging beam, the central ray of such beam being parallel to the axis of symmetry of the antenna assembly. When the planar reflector 21 is positioned so that its reflecting surface is orthogonal to the axis of symmetry of the antenna assembly, the beam from the polarized paraboloid 39 will be reflected directly back to the polarized paraboloid 39 with its polarization rotated by 90°. Due to the polarization being orthogonal to the wires of the collimating reflector, the collimating reflector appears transparent to the energy. As a result, then, the beam reflected from the planar reflector 21 passes through the polarized reflector 39 and thence through the shell lens arrangement 19. When the planar reflector 21 is tilted with respect to the axis of symmetry of the antenna assembly, the beam from the polarized paraboloid 39 is reflected so as to illuminate a different section of the shell lens arrangement 19. The angle between the axis of symmetry of the antenna assembly and the particular section illuminated is, of course, twice the angle of tilt of the planar reflector 21. It will be noted, however, that the area of the illuminated section remains constant (when the shell lens arrangement 19 is a spherical shell) regardless of the angle of tilt of the planar reflector 21. This means that the size of the effective aperture of the antenna arrangement is substantially constant regardless of the direction of the beam finally propagated in free space.

It will also be noted that, when the planar reflector 21 is tilted with respect to the axis of symmetry of the antenna assembly, the plane of polarization of the radio frequency energy reflected from such reflector is not rotated exactly 90°. This means that some cross-polarization loss may be experienced when the planar reflector 21 is oriented in such a manner that a portion of the beam reflected from such reflector impinges on the paraboloid 39.

The shell lens arrangement 19 here comprises a like plurality of metallic antenna elements mounted on the inside and outside of a spherical shell (not numbered). Each one of the antenna elements on the inside of the sperhical shell, as those marked 41, is connected, through a transmission line, as those marked 43, and a phase shifter, as those marked 45, to a metallic corresponding antenna element on the outside of the spherical shell, as those marked 47. For reasons to be made clear hereinafter the length of each one of the transmission lines 43 and the phase shift of each one of the phase shifters 45 are determined to collimate the beam in free space and to increase the deflection angle of such collimated beam. The spacing between the individual antenna elements 41, 47 is not critical to this invention so long as the spacing is such as to avoid grating lobes at the operating frequency. The orientation of each one of the outer antenna elements 47 is such as to accomplish a desired polarization of the radio frequency energy in the beam propagated in free space. It will now be apparent that the shell lens arrangement 19 here is similar to a known nonplanar lens such as the one disclosed in U.S. Pat. No. 3,755,815.

It will be appreciated that the shell lens arrangement 19 is mounted, in any convenient manner (not shown), to the bulkhead 33 so that the center of such assembly is coincident with the center of the ball joint 17. If, then, the bulkhead 33 is a vertical bulkhead in an aircraft (not shown), the axis of symmetry of the shell lens arrangement (and also of the entire antenna arrangement) may be disposed to be coincident with the longitudinal axis (or roll axis) of such aircraft. The scanning of the beam then may be conveniently effected by rotating the planar reflector 21 about the yaw and pitch axes of the aircraft. The angle between the yaw axis and the projection of the central ray of the beam (before and after passing through the shell lens arrangement 19) on the plane defined by the yaw and pitch axes will be deemed sometimes hereinafter to be the azimuth angle of such beam; the angle between the central ray of the beam and the axis of symmetry of the antenna assembly (or roll axis) will sometimes hereinafter be referred to as the "elevation deflection angle".

Figure 2A:
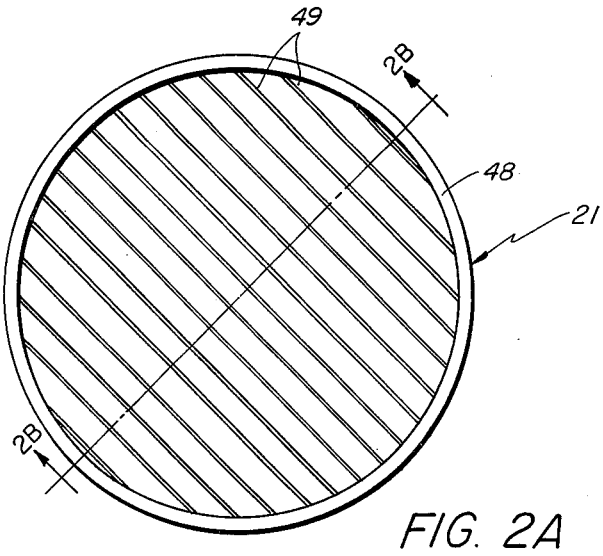
FIGS. 2A and 2B are sketches showing the details of construction of the polarized planar reflector shown generally in FIG. 1.
Figure 2B:
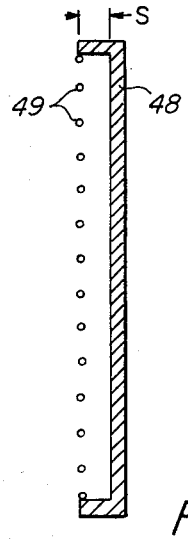

Referring now to FIGS. 2A and 2B it may be seen that the planar reflector 21 here comprises a metallic base member 48 on which a plurality of parallel wires 49 is supported in any convenient manner, as shown. The parallel wires 49 are oriented in such a manner that, when the metallic base member 48 is orthogonal to the axis of symmetry of the antenna assembly, such wires are at an angle of 45° with respect to a pair of reference axes, here the yaw and pitch axes. Further, the parallel wires 49 are spaced at a distance "S" from the metallic base member 48, where S equals one-quarter of the wavelength of the radio frequency energy at the operating frequency.

The polarization of the radio frequency energy out of the monopulse horn 15 (FIG. 1) here is caused to be linear and parallel to the pitch axis with the result that such energy is reflected by the polarized paraboloid 39 (FIG. 1) back toward the planar reflector 21. The direction of the polarization of the radio frequency energy reflected back toward the planar reflector 21, while reversed by 180° upon reflection from the polarized paraboloid 39, is still parallel to the pitch axis. It may be considered that the direction of the polarization of such radio frequency energy is defined by two equal orthogonal components, one parallel to, and the other perpendicular to, the parallel wires 49 overlying the metallic base member 48. The parallel component is reflected, again with its polarization reversed by 180°, by the parallel wires 49. The perpendicular component passes through the parallel wires 49 so that the component is reflected from the metallic base member 48 and then passes back through the parallel wires 49. As a result, the perpendicular component and the horizontal component then have such a relationship with respect to each other that their vector sums produce radio frequency energy whose polarization is linear and parallel to the yaw axis (FIG. 1). The polarized paraboloid 39 (FIG. 1) is transparent to radio frequency energy with such polarization.

Figure 3A:
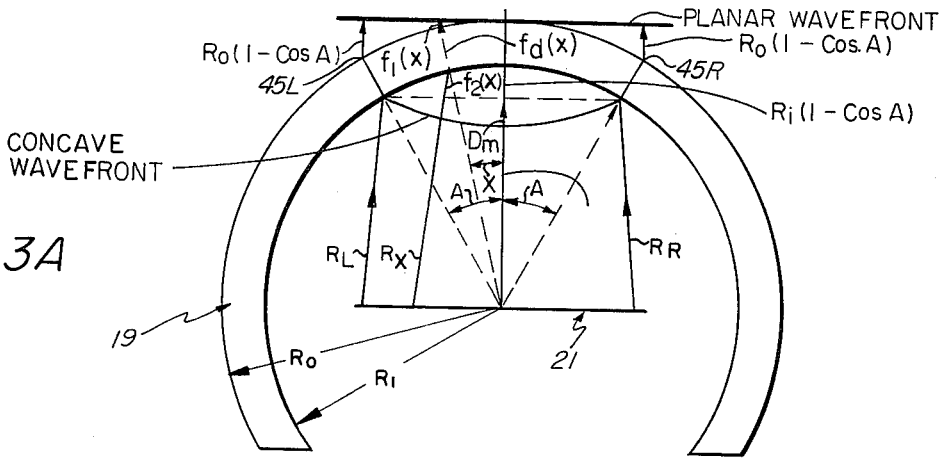
FIGS. 3A, 3B and 3C are sketches illustrating the manner in which physical pathlengths of exemplary rays in any meridional plane must change in passing through the shell lens arrangement shown in FIG. 1 to obtain a collimated beam in free space.
Figure 3B:
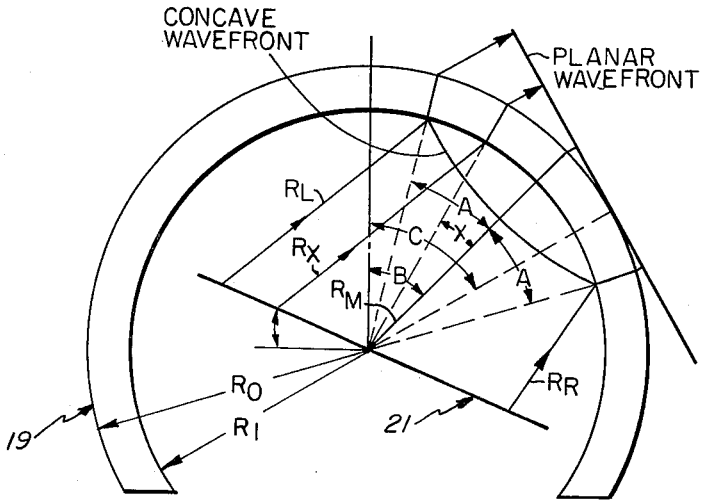
Figure 3C:
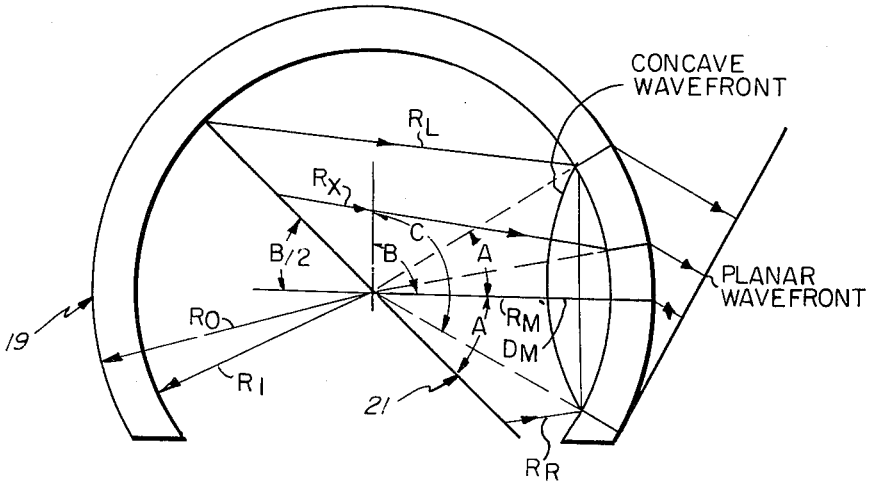

Referring now to FIGS. 3A, 3B and 3C, a clear illustration is given of how the physical pathlengths of meridional rays reflected from the planar reflector 21 (FIG. 1) must change to have a collimated beam finally propagated in free space with changes in the elevation deflection angle, B, of the central ray, $R_M$. For expository reasons, the antenna elements 41, 47, the transmission lines 43 and phase shifters 45 (FIG. 1) have not been shown in FIGS. 3A, 3B and 3C and only the paths of exemplary rays, $R_L$, $R_X$, $R_M$ and $R_R$, have been illustrated. Further, again for purposes of exposition, it has been assumed that the wavefront of the beam reflected from the planar reflector 21 is concave toward the shell lens arrangement 19. How compensation for changes in the pathlengths of nonmeridional rays must be effected will be illustrated hereinafter. Finally, it has been chosen to assume a wavelength of 1 inch for the radio frequency energy in the following discussion.

With the foregoing in mind it may be seen in FIGS. 3A, 3B, 3C that the physical length of the path of any ray from any point on the planar wavefront of a collimated beam in free space to the concave wavefront may be expressed as:

$$L_X = f_{1(x)} + f_{d(x)} + f_{2(x)} \qquad \text{Eq. 1}$$

where $L_X$ is the physical length of the path of a ray from a given point on the planar wavefront to the concave wavefront;

$f_{1(x)}$ is the physical length of the shortest ray from between the point on the planar wavefront and a corresponding point on the outside of the shell lens arrangement;

$f_{d(x)}$ is the physical length of the transmission line between each pair of antenna elements 41, 47 (FIG. 1); and $f_{2(x)}$ is the physical length of the shortest ray between a corresponding point on the inside of the shell lens arrangement and the concave wavefront.

As may be see by comparison of FIGS. 3A, 3B and 3C, the physical length $f_{1(x)}$, of any exemplary ray is a function of the outer radius, $R_o$, of the shell lens arrangement 19, the deflection angle, B, of the beam reflected from the planar reflector 21, the deflection angle, C, of the collimated beam in free space and the angle $x$, which is the angle between the central ray, RM, and a line from the center of rotation of the planar reflector 21 and the point on the inside of the shell lens arrangement 19 on which the exemplary ray impinges. The angle $x$ may vary from 0° to ±A°, where A is the angle between the central ray and the outside of the illuminated portion of the inside of the shell lens arrangement 19. The physical length, $f_{2(x)}$, is a function of the inner radius, $R_i$, of the shell lens arrangement 19, the shape of the concave wavefront and the angle $x$. The physical length $f_{d(x)}$ is, for the present, assumed to be a constant equal to the difference, $R_o$–$R_i$, between the outer and inner radii of the shell lens arrangement 19.

It will now be observed that, as the elevation deflection angle, B, is increased from 0° in a clockwise direction: (a) the point of tangency of the planar wavefront on the shell lens arrangement 19 moves, with respect to the central ray, Rm, in a clockwise direction; (b) for any given angle, $x$, the physical length $f_{1(x)}$ changes with the difference between deflection angle B and the deflection angle C; and, (c) for any given angle, $x$, the physical lengths $f_{2(x)}$ and $f_{d(x)}$ remain constant.

Figure 4A:
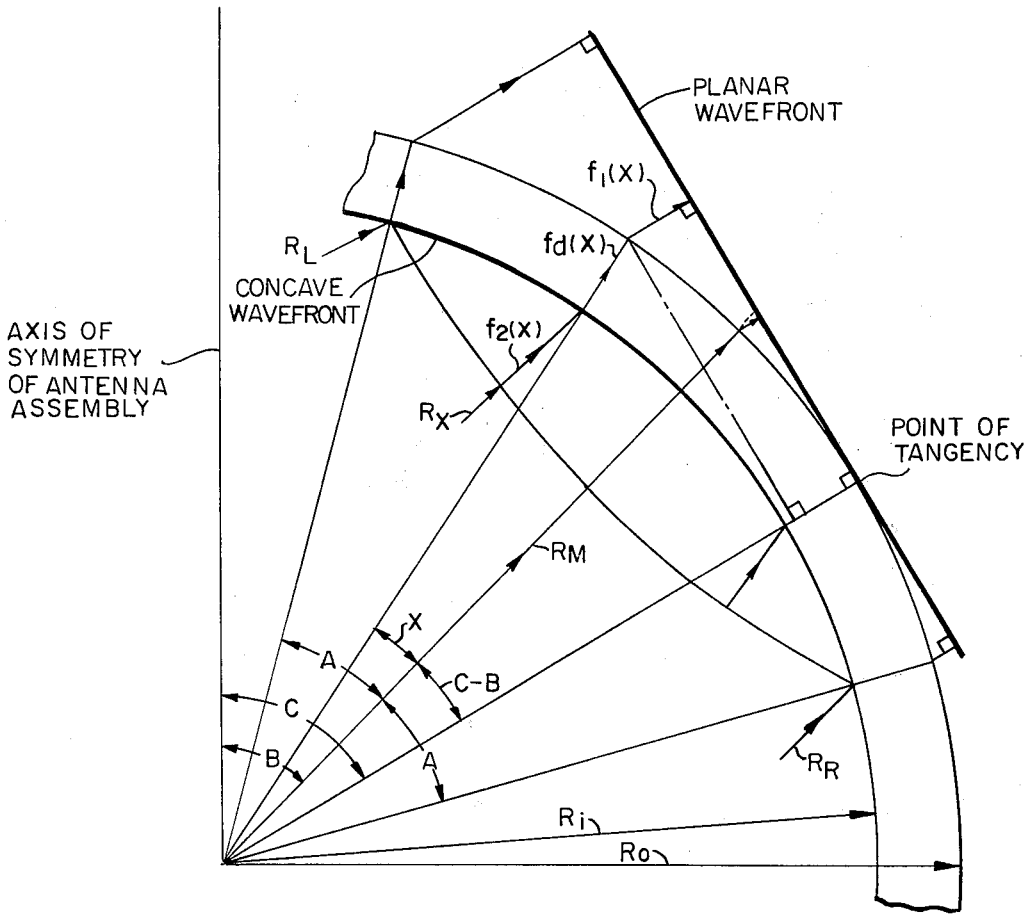
FIGS. 4A and 4B are sketches illustrating how the physical pathlengths of rays in any meridional plane of the shell lens arrangement of FIG. 1 may be calculated.

Referring now to FIG. 4A, the geometrical considerations which control the physical length $f_{1(x)}$ are illustrated. Thus, in FIG. 4A it may be seen that:

$$f_{1(x)} = R_o[1 - \cos(x + (C-B)] \quad \text{Eq. 2}$$

where $R_o$, $x$, $C$ and $B$ are parameters previously defined.

Figure 5:
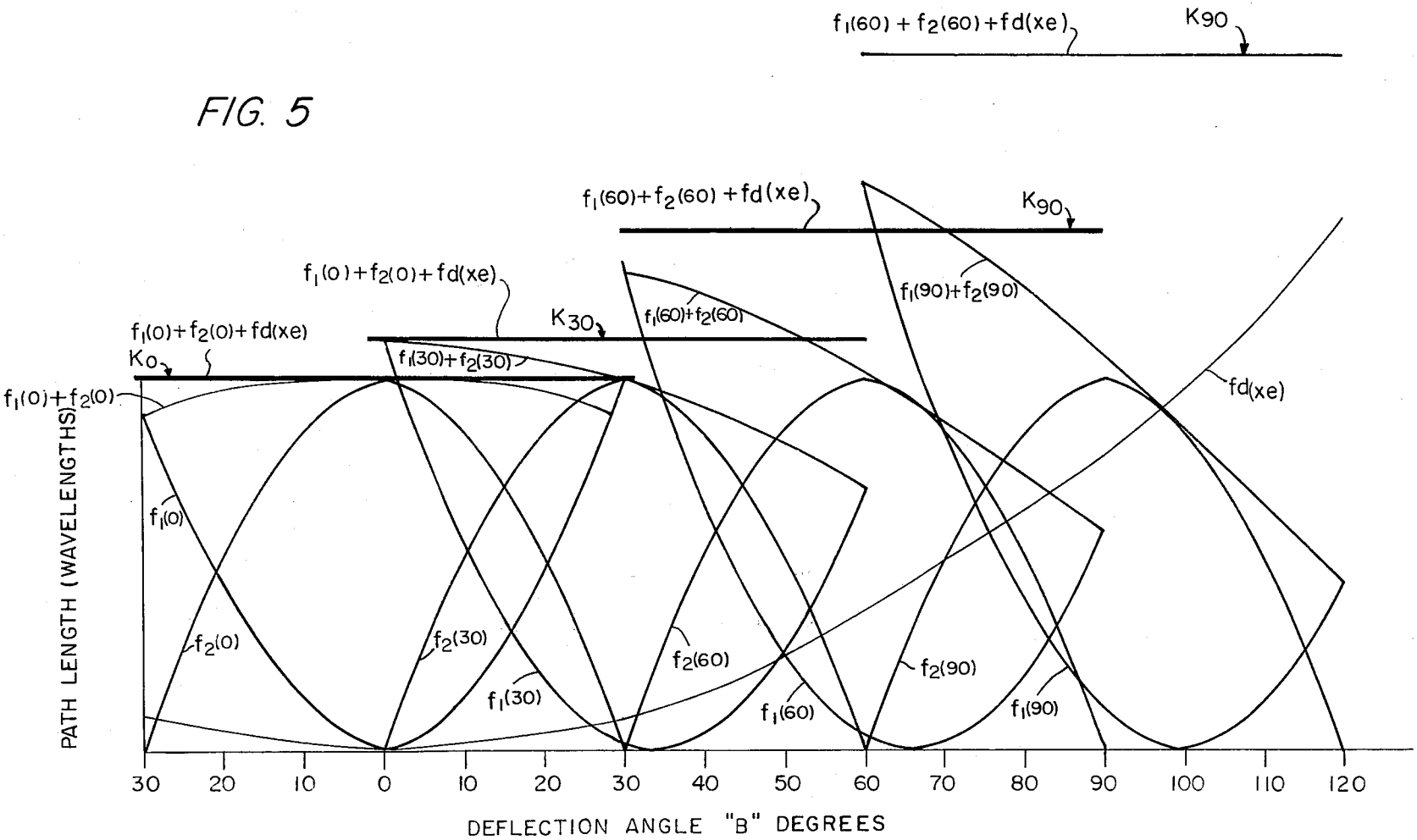
FIG. 5 is a graph illustrating, for a particular shell lens arrangement and a particular frequency of operation, how changes in the physical pathlengths of rays in any meridional plane may be compensated to obtain a partially collimated beam in free space regardless of the direction of such beam.

The pathlengths $f_{1(x)}$ for selected values of the elevation deflection angle B (0°, 30°, 60° and 90° in a clockwise direction), an assumed ratio between the deflection angle C and the deflection angle B of 1.1, assumed dimensions of $R_o = 20$ inches, $R_i = 17$ inches and a limit to the angle $x$ of ±30° (the angle A) are plotted in FIG. 5. Such pathlengths are marked, respectively, $f_{1(0)}$, $f_{1(30)}$, $f_{1(60)}$ and $f_{1(90)}$.

Figure 4B:
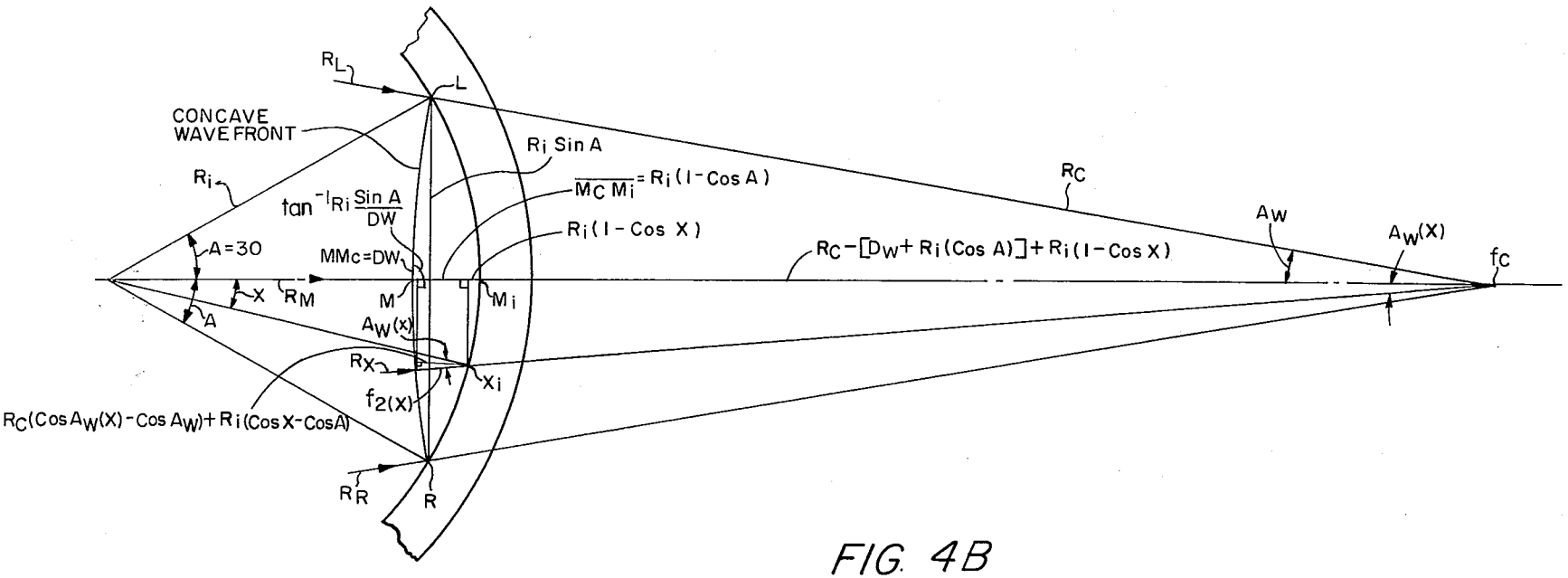

Referring now to FIG. 4B, the geometrical considerations that control the physical length $f_{2(x)}$ are shown. Thus, in FIG. 4B, the rays to the concave wavefront (here substantially spherical) are directed toward a focal point, $f_c$, which lies on the extension of the central ray, RM, regardless of the elevation deflection angle, B. That is to say, the points L, M and R are points on the arc of a circle of radius, $R_c$, centered at the focal point, $f_c$. The physical length $\overline{MM_i}$, of the path between the points M and $M_i$ (the latter being the point at which the central ray, RM, strikes the inner surface of the shell lens arrangement 19) is $$\overline{MM_i} = R_i(1-\cos A) + D_w \quad \text{Eq. 3}$$

where $D_w$ is a length chosen, for reasons to be discussed hereinafter, and $R_i$ and $A$ are as defined hereinbefore.

With a given value of $D_w$, $R_i$ and A, straightforward trigonometric techniques permit a complete solution of the isosceles triangle M, L, $f_c$. That is, the values of $R_c$ and $A_w$ may be computed.

$$A_w = 180° - (2\tan^{-1} R_i \sin A/D_w) \text{ and} \quad \text{Eq. 4}$$

$$R_c = R_i \sin A \csc A_w \quad \text{Eq. 5}$$

At any angle $x$, further trigonometric calculation may be performed to derive the value of $A_{w(x)}$ (the angle at the focal point, $f_c$, between the ray striking the point Xi and the central ray, RM). Thus:

$$A_{w(x)} = \tan^{-1} R_i \sin x/[R_c - D_w + R_i(1 - \cos A)) + R_i(1 - \cos x)] \quad \text{Eq. 6}$$

With the angle $A_{w(x)}$ known, the value of $f_{2(x)}$ may be evaluated as:

$$f_{2(x)} = [R_c(\cos A_{w(x)} - \cos A_w) + R_i(\cos x - \cos A)]/\cos A_{w(x)} \quad \text{Eq. 7}$$

Equation 7 is plotted in FIG. 5 as the curves marked $f_{2(0)}$, $f_{2(30)}$, $f_{2(60)}$ and $f_{2(90)}$ when the deflection angle, B, is 0°, 30°, 60° and 90° and $R_i = 17$ inches and $D_w = 0.652$ inches and A = 30°.

The curves marked $(f_1+f_2)$0, $(f_1+f_2)$30, $(f_1+f_2)$60 and $(f_1+f_2)$90 in FIG. 5 are plots of the sum of $f_{1(x)}$ and $f_{2(x)}$ when the deflection angle, B, equals 0°, 30°, 60° and 90°. It will be noted that, at any deflection angle, B, the sum of $f_{1(x)}$ and $f_{2(x)}$ varies as the angle $x$ is changed from zero to ±A° (here 30°) and, if collimation is to be attained, the term $f_{d(x)}$ must change as the deflection angle, B, changes.

The manner in which the value of the term $f_{d(x)}$ is derived will now be explained. It is convenient in this connection now to consider the various pathlengths in terms of electrical pathlengths rather than physical pathlengths. Thus, in terms of wavelengths, Equation 1 may be expressed as:

$$L_{x(e)} = [f_{1(x)} + f_{d(x)} + f_{2(x)}]/L \quad \text{Eq. 8}$$

where $L_{x(e)}$ is the electrical length, in wavelengths at the operating frequency of the radio frequency energy being propagated, of the paths of any ray from the concave wavefront to the planar wavefront and $L$ is the wavelength of such energy.

With a wavelength, L, here assumed to be 1 inch, the scale factor of the ordinate of FIG. 5 need not be changed and Equation 1 may be used to define $L_{x(e)}$.

It will be obvious, if the wavefront of the beam finally propagated in space is to be planar, that $$L_{x(e)} = K = f_{1(x)} + f_{2(x)} + f_{d(x)} \quad \text{Eq. 9}$$

where $K$ is a constant at any particular value of the deflection angle, B, and the parameters $f_{1(x)}$, $f_{2(x)}$ and $f_{d(x)}$ are as defined hereinbefore.

For clarity, the required adjustment in the electrical length, $f_{d(xe)}$, between the inside and the outside of the shell lens arrangement 19 (which adjustment is required to achieve collimation in any meridional plane) will now be substituted for the parameter $f_{d(x)}$. The required adjustment in electrical length, $f_{d(xe)}$, differs from the parameter $f_{d(x)}$ because of the transmission lines 43 and phase shifters 45 (FIG. 1). By changing the lengths of such transmission lines (for the while leaving all phase shifters 45 set to a 0° phase shift) and adjusting the degree of concavity of the wavefront impinging on the inside of the shell lens assembly, the equality of Equation 9 may be met in a practical way. That is, in the particular arrangement being discussed (with $R_o = 20$ inches; $R_i = 17$ inches; $A = 30°$; $C/B = 1.1$ and $L = 1$ inch), the equality of Equation 9 may be met for any angle of $x$ between 0° and ± 30° within any desired tolerance, say ± 0.05 inch. This, in turn, means that the phase error in the meridional plane across the planar wavefront propagated in free space may be held to less than, say, 18°.

The proper values of $D_w$ and $f_{d(xe)}$ may be determined to a sufficient degree of accuracy for an antenna assembly having the assumed parameters by reference to FIG. 5. Thus, in the FIGURE the value of $D_w$ may be taken to be that value of concavity of the beam falling on the inside of the shell lens arrangement 19 (FIG. 1) which compensates for the thickness of that arrangement plus one-half the difference in the pathlengths of the ray, $R_L$, as the deflection angle is changed from 0° to a selected angle (here 30°). The compensation, here designated as $D'_w$, for the thickness of the shell lens arrangement 19 may be calculated by evaluating:

$$D'_w = (R_o - R_i)(1-\cos A) \quad \text{Eq. 10}$$

The value of $D_w$ is 0.652 inches for an antenna assembly having the assumed parameters.

The value of $f_{d(xe)}$, at each deflection angle, B, may be seen in FIG. 5 to be the difference between the straight line ($K_0$, $K_{30}$, $K_{60}$, $K_{90}$) and the sum of $f_1$ and $f_2$ at each deflection angle, B. Such a difference is shown in FIG. 5 as the curve marked "$f_{d(xe)}$".

Advantage may be taken of the so-called "modulo-$2\pi$" effect experienced with transmission lines or phase shifters. The length of transmission line represented by the function $f_{d(xe)}$ at each deflection angle, B, may be reduced by an integral multiple of the wavelength of the radio frequency energy to be transmitted (or received) without any adverse effect on the collimation of the beam of such energy. The dotted curves marked $f_{d(xe)i}$, $f_{d(xe)ii}$, $f_{d(xe)iii}$ and $f_{d(xe)iv}$ (together with the portion of $f_{d(xe)}$ below one wavelength) illustrate how the lengths of the transmission lines 43 (FIG. 1) may be varied if the maximum length of any one of such lines is to be 1 inch.

It will also be observed that, although satisfactory collimation of all rays in any meridional plane may be achieved as just explained, all of the rays in the beam (when the deflection angle, B, is not 0°) are not in a meridional plane. Therefore, if more precise collimation is to be achieved for all rays in the beam, it is possible to compensate for the differences in pathlengths between rays in the meridional plane and the rays in all nonmeridional planes.

Figure 6B:
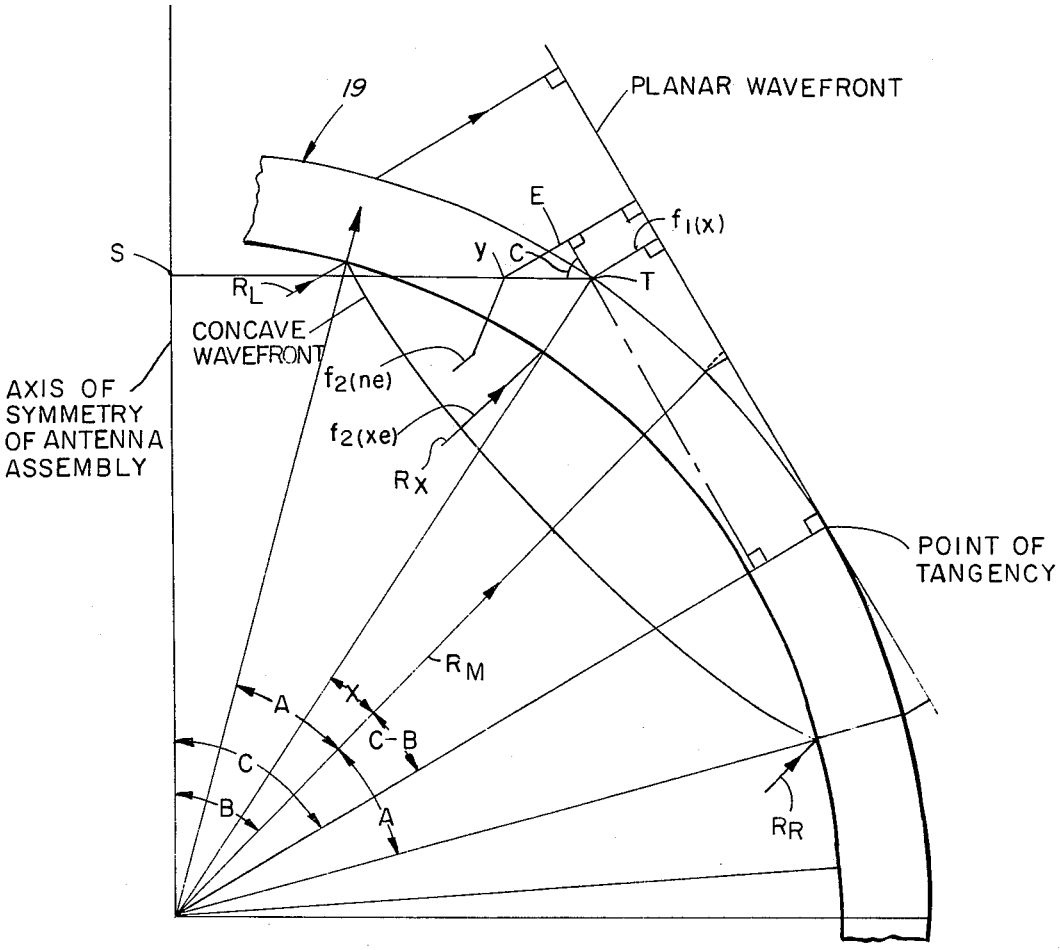
FIGS. 6A and 6B are sketches illustrating the manner in which the physical pathlengths of rays in any non-meridional plane may be calculated.
Figure 6A:
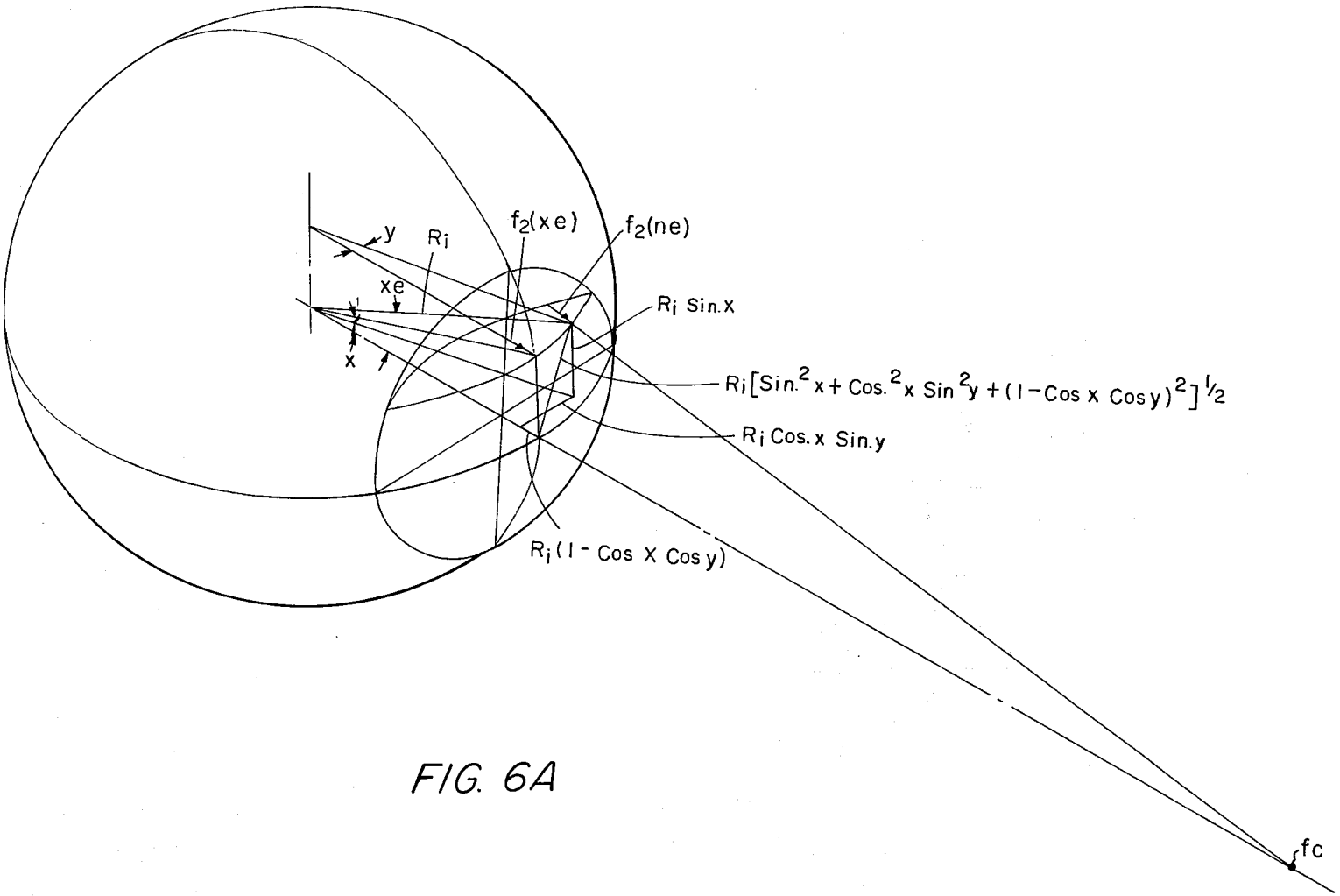
Figures 7A, 7B, 7C, 7D:
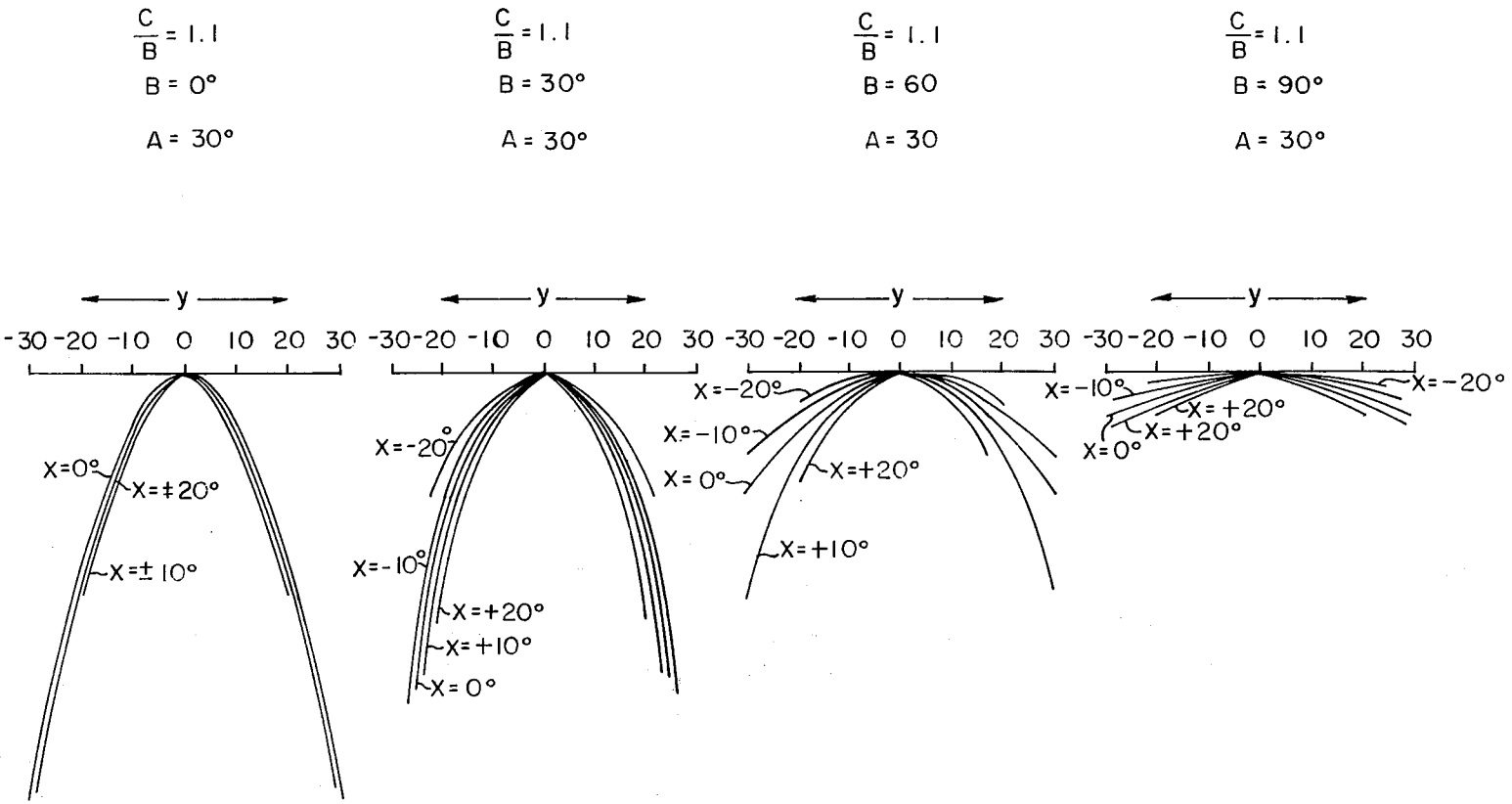
FIGS. 7A through 7D are graphs illustrating, for a particular shell lens arrangement and a particular operating frequency, how changes in the physical pathlengths of all rays due to changes in deflection angle must be compensated to obtain a substantially completely collimated beam in free space regardless of deflection angle.

Referring now to FIG. 6A, the geometrical considerations which determine the values of the function $f_{2(x)}$ for nonmeridional rays (meaning rays in a nonmeridional plane) are shown. For convenience, when referring to nonmeridional rays the designation $f_{2(ne)}$ will be used. In FIG. 6A it may be seen that the symmetry of the shape of the illuminated portion of the inside of the shell lens arrangement 19 (FIG. 1) permits the value of the function $f_{2(ne)}$ to be found for any nonmeridional ray. That is to say, at any point $x$, $y$ within the illuminated portion of the inside of the shell lens arrangement 19, the value of the function $f_{2(ne)}$ is the same as the value of the function $f_{2(x)}$ in the meridional plane evaluated at the angle $xe$. The value of the angle $xe$ for any angles $x$, $y$ within the illuminated portion of the shell lens arrangement 19 is independent of the deflection angle, B, and may be expressed as:

$$xe = 2\sin^{-1}[\sin^2 x + \cos^2 x \sin^2 y + (1 - \cos x \cos y)^2]^{\frac{1}{2}}/2 \qquad \text{Eq. 11}$$

where $y$ is the dihedral angle between the meridional plane and the nonmeridional plane containing the point at which the nonmeridional ray of interest impinges on the inside of the shell lens arrangement 19.

The value of the function $f_{2(ne)}$ may then be computed by deriving (using Equation 6) the corresponding angle $A_{w(ne)}$ and then applying such corresponding angle $A_{w(ne)}$ to Equation 7.

Referring now to FIG. 6B, the geometrical considerations which determine the value of the function $f_{1(x)}$ for nonmeridional rays is shown. Here, for convenience, the designation $f_{1(ne)}$ will be used to distinguish between meridional and nonmeridional rays. Thus, in FIG. 6B it may be seen that the projection of any nonmeridional ray (at any angle $(B-x)$ and any angle $y$) to the planar wavefront of the beam finally propagated in space is a line parallel to the line marked $f_{1(x)}$. The length of such parallel line may be expressed as:

$$f_{1(ne)} = \overline{Ey} + f_{1(x)} \qquad \text{Eq. 12}$$

where $f_{1(x)}$ is the length determined by applying Equation 2 and $\overline{Ey}$ is a length determined in a manner now to be described.

In FIG. 6(B) the length of the line $\overline{ST}$ may be expressed as:

$$\overline{ST} = R_o \sin(B-x) \qquad \text{Eq. 13}$$

and the length of the line $\overline{Sy}$ may be expressed as:

$$\overline{Sy} = R_o \sin(B-x)\cos y \qquad \text{Eq. 14}$$

The length $\overline{Ey}$ then may be expressed as:

$$\overline{Ey} = (\overline{ST} - \overline{Sy})\sin C = R_o \sin(B-x)\sin C\,(1-\cos y) \qquad \text{Eq. 15}$$

The total electrical pathlength of any nonmeridional ray at any angle $(B-x)$ then is:

$$L_{X(e)} = f_{1(x)} + \overline{Ey} + f_{2(ne)} + f_{d(B-x)} \qquad \text{Eq. 16}$$

It will be appreciated that, except for the fortuitous case when $$f_{2(x)} - f_{2(ne)} = -\overline{Ey}, \qquad \text{Eq. 17}$$

the equality of Equation 9 is not met by Equation 16. To put it another way, the electrical pathlengths of nonmeridional rays oridinarily do not allow a planar wavefront to be provided for the beam finally propagated in space unless the function $f_{d(B-x)}$ is adjusted to compensate for the differing pathlengths of such rays. The pathlength of any nonmeridional ray may be calculated, however, by applying Equations 6 and 7 with appropriate substitutions. Examples showing the changes in pathlengths (when the deflection angle B is 0°, 30°, 60° and 90° with $x$ equal to 0°, 10° and 20°) are plotted in FIGS. 7A, 7B, 7C, 7D. Referring now to the just-mentioned FIGURES it will be observed that: (1) the meridional ray corresponding to a given deflection angle, B, is the longest ray (in electrical length) of any ray at that deflection angle; and (2) the difference between the electrical length of the meridional ray at any deflection angle, B, and the electrical length of the ray at any given angle $y$ (with the deflection angle B and the angle $x$ constant) is equal to the difference between the actual electrical length of any ray and the electrical length of such ray required to attain a planar wavefront on the finally propagated beam; and (3) the actual electrical length of any particular nonmeridional ray is dependent upon both the deflection angle, B, and the azimuth angle of the beam.

The last two just-mentioned constraints make it impossible (if the shape of the beam on the inside of the shell lens arrangement 19 is not changed as elevation or azimuth angle is changed) to use fixed lengths of transmission line (such as transmission lines 43 (FIG. 1)) to precisely adjust the electrical lengths of the nonmeridional rays. Therefore, to accomplish the requisite adjustment of the electrical length between the antenna elements 41, 47 (FIG. 1) the phase shifters 45 may be used. Each phase shifter is controlled, in a conventional way, to provide the requisite change in electrical pathlength for each ray. Thus, in FIG. 1, beam position signals, i.e. signals indicative of the deflection angle B and the azimuth angle of the central ray in the beam illuminating the selected portion of the inside of the shell lens arrangement 19, may be transmitted to a conventional switching matrix 51 and a correction computer 53. The switching matrix 51 responds to the beam position signals to connect the phase shifter 45 between the antenna elements 41, 47 corresponding to the central ray in the beam illuminating the inside of the shell lens arrangement 19 (along the phase shifters 45 between all other antenna elements 41, 47 in the illuminated portion) to the correction computer 53. The latter, in accordance with the deflection angle, B, calculates appropriate "$x$, $y$" correction signals for the phase shifters 45.

The matrices of FIGS. 8A through 8D show how the correction computer 53 controls the phase shifters 45 to allow satisfactory collimation of substantially all rays, whether meridional or nonmeridional. In FIGS. 8A through 8D, the upper number at each node represents the increase in the length of the transmission line 43 to collimate meridional rays when the deflection angle B is 0°, 30°, 60° and 90°. In each different matrix, the upper numbers are the same for each different value of $(B-x)$. These numbers indicate the lengths of the transmission lines 43 (FIG. 1) required to collimate meridional rays. The number in parentheses adjacent each node indicates the phase shift (expressed in wavelengths) required to collimate nonmeridional rays. It will be noted that, for any value of $(B-x)$, the numbers in parentheses change to correspond with the curves in FIGS. 7A through 7D. These numbers, then, represent the phase shift (again expressed in wavelengths reduced by "modulo-$2\pi$") which must be imparted by the phase shifters 45 (FIG. 1) to collimate the nonmeridional rays at the chosen deflection angles. If the total phase shift indicated by the sum of the upper number and the number in parentheses at each node is taken to be the phase shift required to collimate the beam finally propagated in free space, it will be observed that the change in pathlength at any angle $y$ (except $y = 0°$) will not be correct to attain the desired amplification factor. If, however, the average value of each column of numbers in parentheses shown in FIGS. 8A through 8D is taken as an indication of the setting of the phase shifters, then the angle amplification factor for all rays will remain constant, but the pathlengths of all nonmeridional rays may be somewhat in error.

The magnitude of the pathlength error induced by averaging the correction for nonmeridional rays (assuming the same parameters used hereinbefore) is directly related to the magnitude of the angles $x$ and $y$. This fact suggests that an amplitude taper, symmetric around the central ray, $R_M$, of the beam illuminating the inside of the shell lens arrangement 19 (FIG. 1) would be helpful. That is to say that if, for example, a cosine taper (in amplitude) were to be imparted across the beam, the greater part of the radio frequency energy in the beam would be concentrated near the center where pathlength errors are at their minimum. It is noted, however, that if the taper across the beam in space is to be maintained constant as the deflection angle, B, is changed, the taper across the beam illuminating the inside of the shell lens arrangement must be varied.

Having described a preferred embodiment of this invention, it will now be apparent to one of skill in the art that many changes may be made without departing from the inventive concepts. Thus, it is obvious that the operating frequency of the system may be changed; as a matter of fact, if such frequency is lowered to increase the wavelength of the radio frequency energy, the effect of pathlength error will be lessened. Further, although it has been assumed throughout the foregoing discussion that an angle amplification factor of 1.1 is to be used, other angle amplification factors may be used, so long as provision is made to compensate (by changing the lengths of the transmission lines and the settings of the phase shifters) for the net change in the physical lengths of the rays as the deflection angle is changed. Finally, if the difference between the radii of the inside and outside of the shell lens arrangement 19 is changed, the degree of concavity of the wavefront of the beam illuminating the inside of the shell lens arrangement 19 may be changed. That is to say, if $R_i$ is changed to approach $R_o$, the concavity of such beam could be decreased to maintain equality of the lengths of the rays. In this connection it will be recognized that a converging beam such as is produced by reflection from the polarized paraboloid shown in FIG. 1 may be produced by a reflector of a different shape. In view of the foregoing, it is felt that this invention should not be restricted to its disclosed embodiment, but rather should be limited only by the spirit and scope of the appended claims.

What is claimed is:

1. An antenna arrangement for directing a collimated beam of radio frequency energy, such arrangement comprising the combination of:

a. beam forming means, including a feed horn and a curved polarized reflector disposed in a fixed spatial relationship one to the other, for forming a linearly polarized covergent beam of radio frequency energy;

b. first beam directing means, including planar polarized reflector rotatably mounted in the path of the linearly polarized convergent beam, for changing the direction of the linearly polarized convergent beam of radio frequency energy in accordance with the position of the planar polarized reflector and for rotating the direction of polarization of the radio frequency energy in the linearly polarized covergent beam by substantially 90°;

c. second beam directing means, including a constrained electromagnetic lens disposed in the path of the linearly polarized convergent beam from the first beam directing means, for simultaneously refracting and collimating the radio frequency energy in such beam to produce a collimated beam in free space.

2. An antenna arrangement as in claim 1 wherein the centers of the first beam directing means and the constrained electromagnetic lens are substantially coincident and the feed horn is a monopulse feed.

3. An antenna arrangement as in claim 2 wherein the constrained electromagnetic lens comprises:

a. a support structure having the shape of a hollow hemisphere;

b. a first plurality of antenna elements disposed over the inner surface of the support structure in a coupling relationship with the radio frequency energy reflected from the frist beam deflecting means;

c. a second like plurality of antenna elements disposed over the outer surface of the support structure to form, in conjunction with the individual antenna elements in the first plurality thereof, a third like plurality of pairs of antenna elements.

d. means for interconnecting, through constrained paths, the antenna elements in each pair thereof, the electrical length of each one of such constrained paths being selected to direct and collimate the beam in free space.

4. The antenna arrangement claimed in claim 3 wherein the means for interconnecting the antenna elements in each pair thereof comprises a length of transmission line.

5. The antenna arrangement as in claim 4 wherein the means for interconnecting the antenna elements in each pair thereof comprises, in addition to a length of transmission line, a variable phase shifter.

* * * * *